United States Patent [19]

Apps

[11] Patent Number: 4,823,955

[45] Date of Patent: Apr. 25, 1989

[54] NESTING AND STACKING STORAGE CONTAINER

[75] Inventor: William P. Apps, Anaheim, Calif.

[73] Assignee: Rehrig-Pacific Company, Inc., Los Angeles, Calif.

[21] Appl. No.: 89,992

[22] Filed: Aug. 27, 1987

[51] Int. Cl.[4] ..... B65D 21/02; B65D 21/04

[52] U.S. Cl. ..... 206/506; 206/505; 206/507; 206/510; 206/512; 220/94 A

[58] Field of Search ..... 206/504, 505, 507, 510, 206/511, 512, 513, 506; 220/94 A, DIG. 15

[56] References Cited

U.S. PATENT DOCUMENTS

| | | | |
|---|---|---|---|
| 2,916,161 | 12/1959 | Schaefer | 206/512 |
| 3,149,747 | 9/1964 | Burgess . | |
| 3,485,408 | 12/1969 | Benesch . | |
| 3,760,970 | 9/1973 | Lutz | 206/511 |
| 3,819,044 | 6/1974 | Bockenstette | 206/507 |
| 3,884,384 | 5/1975 | Cloyd | 220/94 A |
| 3,901,406 | 8/1975 | Kivett . | |
| 4,042,107 | 8/1977 | Kendig . | |
| 4,247,004 | 1/1981 | Bird | 206/506 |
| 4,249,671 | 2/1981 | Crolli | 220/DIG. 15 |
| 4,287,997 | 9/1981 | Rolfe et al. . | |
| 4,366,905 | 1/1983 | Forshee . | |
| 4,397,404 | 8/1983 | Blanchette . | |
| 4,473,155 | 9/1984 | Howitt | 206/505 |
| 4,523,692 | 6/1985 | Lemkin . | |
| 4,591,065 | 5/1986 | Foy . | |
| 4,597,503 | 7/1986 | Lates | 220/DIG. 15 |
| 4,601,393 | 7/1986 | Veenman et al. . | |
| 4,671,411 | 6/1987 | Rehrig et al. . | |

FOREIGN PATENT DOCUMENTS

| | | | |
|---|---|---|---|
| 1408457 | 10/1975 | United Kingdom | 206/507 |
| 2023543 | 1/1980 | United Kingdom | 206/511 |

OTHER PUBLICATIONS

Advertisement for Microphor, Inc., The "All-Purpose" Bin.

*Primary Examiner*—David T. Fidei

*Attorney, Agent, or Firm*—Banner, Birch, McKie & Beckett

[57] ABSTRACT

A nesting and stacking storage container is disclosed. The storage container has two opposing end walls, two opposing side walls disposed between the end walls, and a generally rectangular bottom joining the end walls and the side walls. A handle device is disposed on both end walls and a securing device is mounted on the handle device to secure two storage containers top to top. The storage container also includes feet disposed at each corner on the outer surface of the bottom of the container to facilitate mounting containers top to bottom and to securely fasten two containers bottom to bottom. The feet prevent relative lateral movement between two containers.

24 Claims, 6 Drawing Sheets

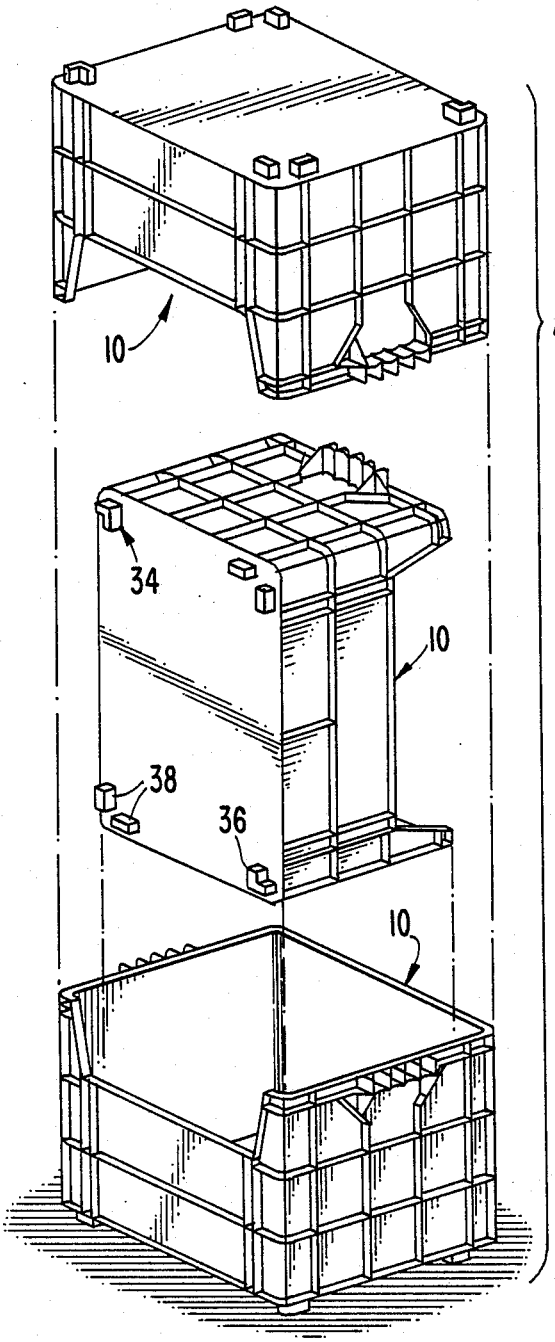
FIG. 4a
FIG. 4b
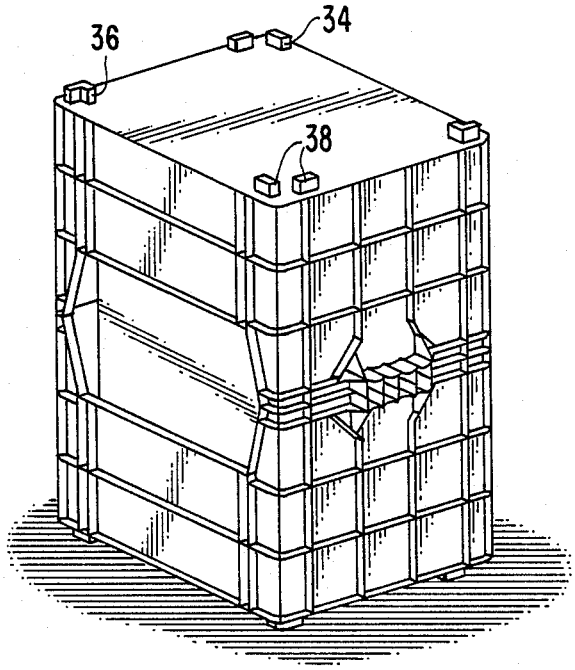

NESTING AND STACKING STORAGE CONTAINER

TECHNICAL FIELD

The present invention relates to a stacking and nesting storage container. More particularly, the present invention relates to a stacking and nesting storage container which may be stacked top to bottom and bottom to bottom, and which may be nested and secured top to top with others storage containers.

BACKGROUND OF THE INVENTION

The use of storage containers or bins formed from synthetic resin materials or plastics is well known. Plastic rectangular containers which are open at the top have various industrial commercial, and domestic applications. Such bins have four sides and a bottom, and often have handles disposed near the top of two opposite sides to facilitate carrying the bins. The bins are often stackable top to bottom. Legs or protrusions disposed on the outer bottom surface of the containers fit within the top opening of another container to permit easy top to bottom stacking. Although these contains are stackable top to bottom, they are not readily and securely stackable bottom or top to top.

When the containers are empty one container is often placed sideways within a second container and then to place a third container on top of the second container so that the second and third containers have their top open surfaces meeting. This saves space in storing and transporting empty containers. However, this nested configuration of three containers is not readily and securely stackable on another nested set of three containers, with the bottom of one container of the stack disposed against the bottom of one container of another stack.

Moreover, in stacking two containers top to top so that one container is rightside up and the other container is upside down, with or without a sideways container in between the outer two containers, there are no known simple and convenient methods for fastening two containers top to top. One known method is to tie the two containers together by threading a separate plastic tie through holes near the top surface in the side walls of the containers to secure them together. However, this is time consuming and cumbersome and requires the use of additional plastic tying devices.

SUMMARY OF THE INVENTION

It is an object of the present invention to provide a nesting and stacking storage container which is stackable top to bottom with other storage containers.

It is another object of the present invention top provide a nesting and stacking storage container having feet which enable the container to be securely staked bottom to bottom with another storage container without excessive relative lateral movement.

It is another object of the present invention to provide a nesting and stacking storage container which may be securely stacked top to top with another storage container by an integral securing device which prevents the two containers from readily coming apart.

It is another object of the present invention to provide a nesting and stacking storage container accomplishing all of the above objects and which is compatible for top to bottoms tacking with existing containers having similar dimensions.

The above and other objects are accomplished by the nesting and stacking storage container of the present invention which includes four walls and a bottom surface joining the walls. There are two end walls and two side walls disposed opposite each other, forming a generally rectangular opening. Near the top edge of each end wall is a handle. The handle includes four curved portions to accommodate the fingers of a user and five vertical ribs which provide rigidity and prevent deformation of the handles when loaded containers are lifted by the handles. A securing device is disposed on each handle and secures two containers together when they are stacked top to top. The securing device uses a tongue and groove connection wherein the tongue portion is disposed on one handle and the groove portion is disposed on the other handle. Feet are disposed at each corner of the outer surface of the bottom of the container. An L-shaped foot is disposed in each of two diagonally opposed corners and two spaced rectangular feet are disposed in each of the other two diagonally opposed corners. These feet interlock complementarily when two containers are stacked bottom to bottom. The feet prevent relative lateral movement between two stacked containers and the feet are also dimensioned and located so that the bottom of one container may be stacked within the top of another container.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

BRIEF DESCRIPTION OF THE DRAWINGS

FIG. 4*a* is an exploded perspective view of three storage containers in position to be nested top to top. FIG. 4*b* is a perspective view of three storage containers nested top to top.

DETAILED DESCRIPTION OF PREFERRED EMBODIMENTS

Figure 1:
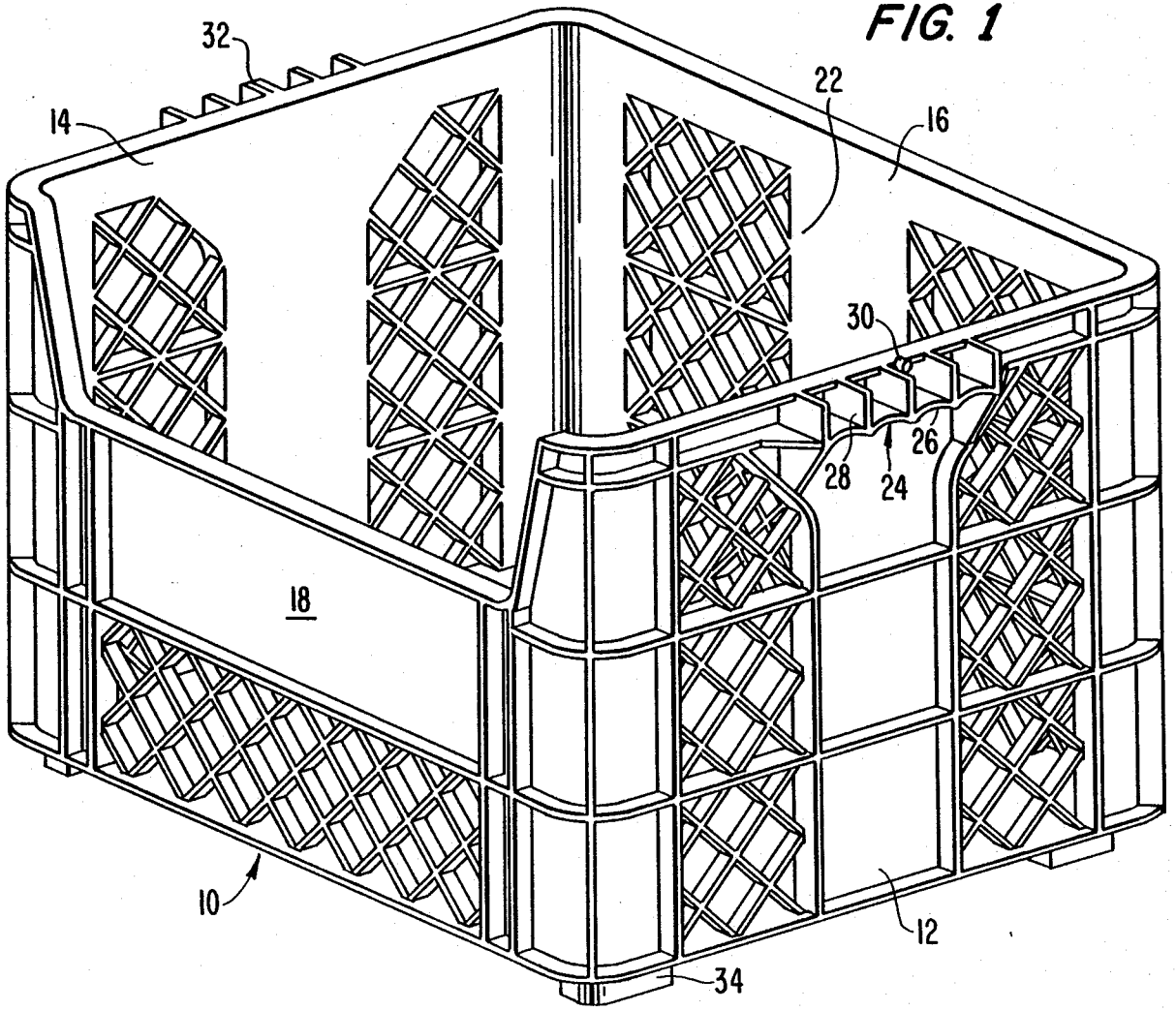
FIG. 1 is a perspective view of a storage container according to one embodiment of the present invention.
Figure 2:
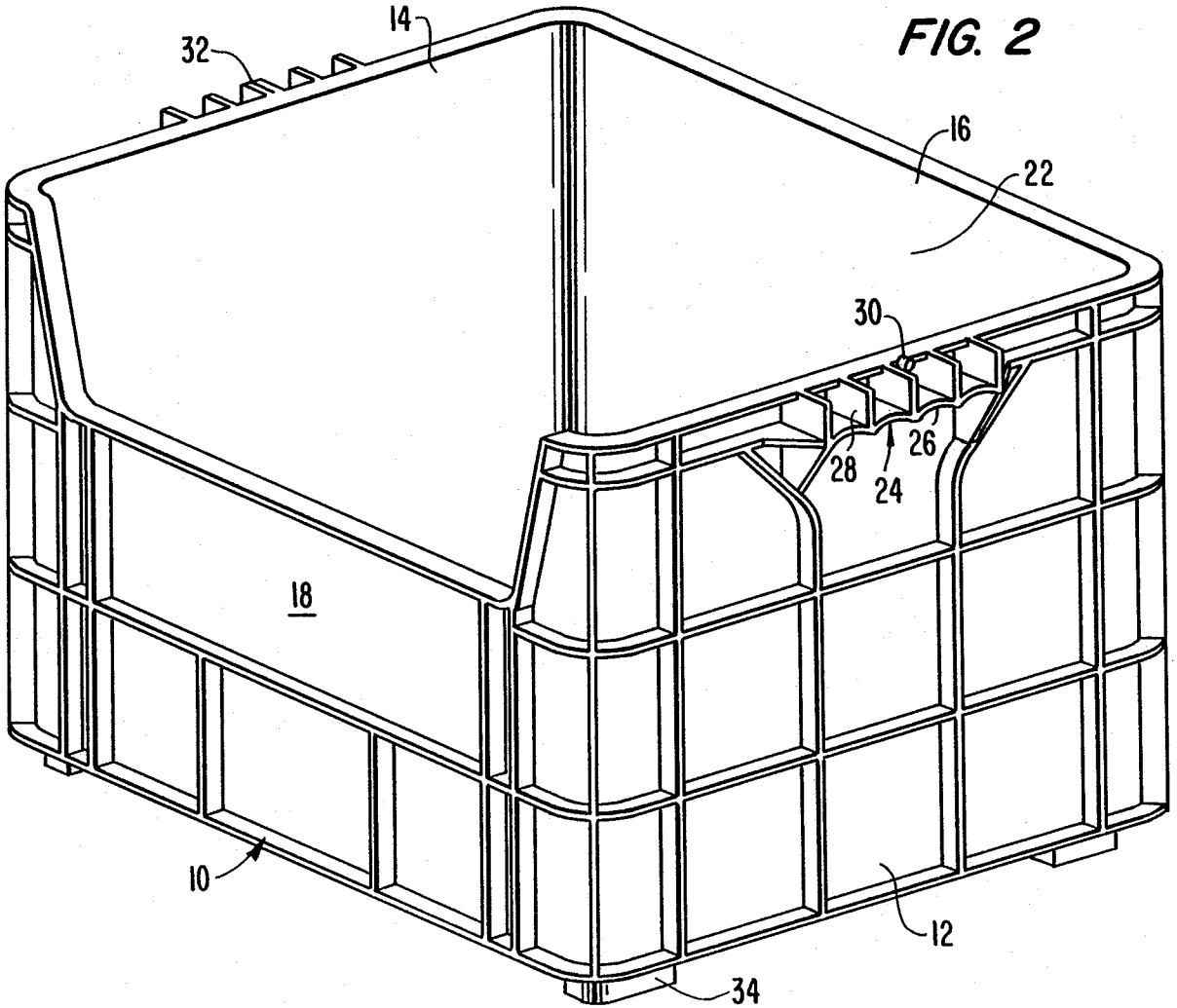
FIG. 2 is a perspective view of a storage container according to another embodiment of the present invention.

FIGS. 1 and 2 are perspective views of different embodiments of the nesting and stacking storage container according to the present invention. In FIG. 1 the storage container is formed of an open plastic lattice construction and may be used, for example, to store paper or cans. In FIG. 2 the storage container is formed of a solid plastic design and may be used, for example, to store glass.

Referring to the figures, container 10 includes four walls: end wall 12, end wall 14, side wall 16, and side wall 18. However, containers having only three walls, and containers having short side walls may be used. Bottom 20 joins the walls to form a rectangular boxlike container or bin having top opening 22.

Handle grips 24 are disposed in the center of end walls 12 and 14 at their top edge. Handle grip 24 includes curved portions 26 which facilitate and accommodate the fingers of a user. Handle grips 24 also include vertical ribs 28 which reinforce handle grips 24 and prevent deformation of both handle grips 24 and container 10 when a loaded container 10 is being lifted. Mounted on handle grips 24 are locking or securing devices for securing two storage containers top to top when nested together. In other embodiments, the securing devices need not be mounted on handle grips 24 but may be mounted directly on the side walls of container 10. The securing devices amy take the form of any of various securing type devices. Preferrably, complementary male and female elements are used. The male and female elements may assume any of various forms. In the preferred embodiment, a tongue and groove connection is used as the securing device, and this connection may assume various forms alternative to that illustrated. As shown in the figures, tongue 30 is disposed on one handle grip 24 of container 10. Groove 32 is disposed on the other handle grip 24.

On the outer surface of bottom 20 of container 10 at each corner are feet 34. One foot 34 is disposed at each corner. There are two complementary shapes for feet 34 as shown in the figures. Foot 34 may be L-foot 36 or spaced rectangular feet 38. One L-foot 36 is disposed in each of two opposed diagonal corners of bottom 20 and two spaced rectangular feet 38 are disposed in each of the two remaining opposed diagonal corners of bottom 20. Numerous other configurations for complementary foot pairs may also be used.

Figure 3:
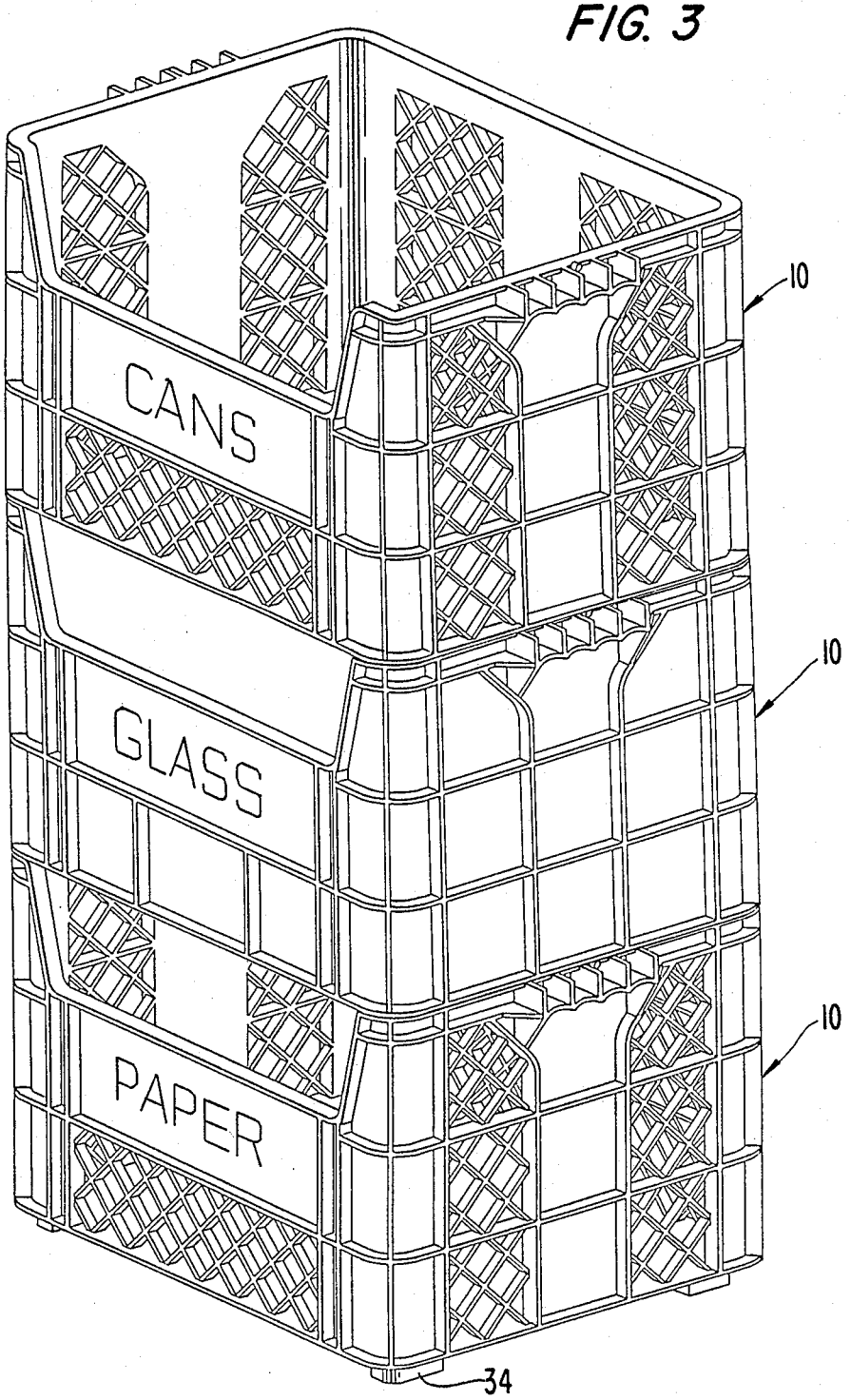
FIG. 3 is an illustration of three storage containers stacked top to bottom.

As shown in FIG. 3, a purality of containers 10 may be stacked top to bottom with the feet 34 of bottom 20 of one container 10 disposed within top opening 22 of an adjacent container 10. Feet 34 are located on bottom 20 so that they fit closely within top opening 22 of an adjacent container 10 to prevent relative lateral movement between the two containers.

Figure 5:
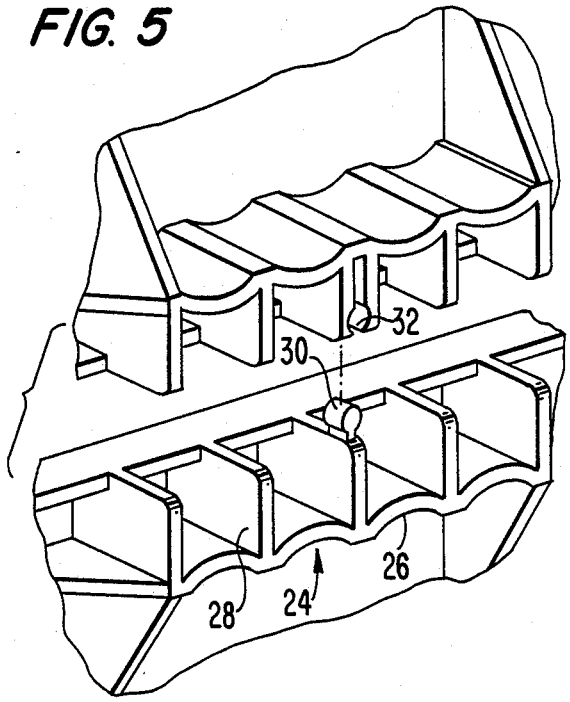
FIG. 5 is an enlarged perspective view of the handles and securing device of the storage container of the present invention.

As illustrated in FIGS. 4 and 5, three containers 10 may be nested with one container 10 disposed sideways inside two other containers 10. The outer two containers 10 are nested top to top as best shown in FIG. 4*b*. In this configuration, the securing device prevents the outer containers 10 from inadvertently separating. The securing device holds two containers together with or without a third container in between until they are forceably separated. FIG. 5 shows a closeup view of tongue 30 and groove 32 of the securing device.

Figure 7:
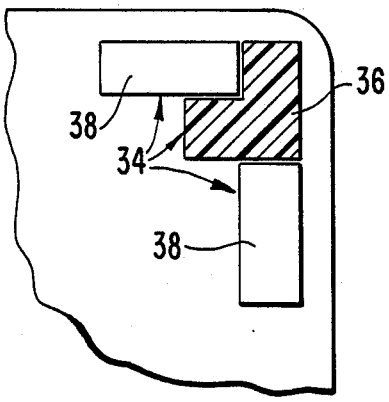
FIG. 7 is a plan view of interfitted complementary feet.
Figure 6:
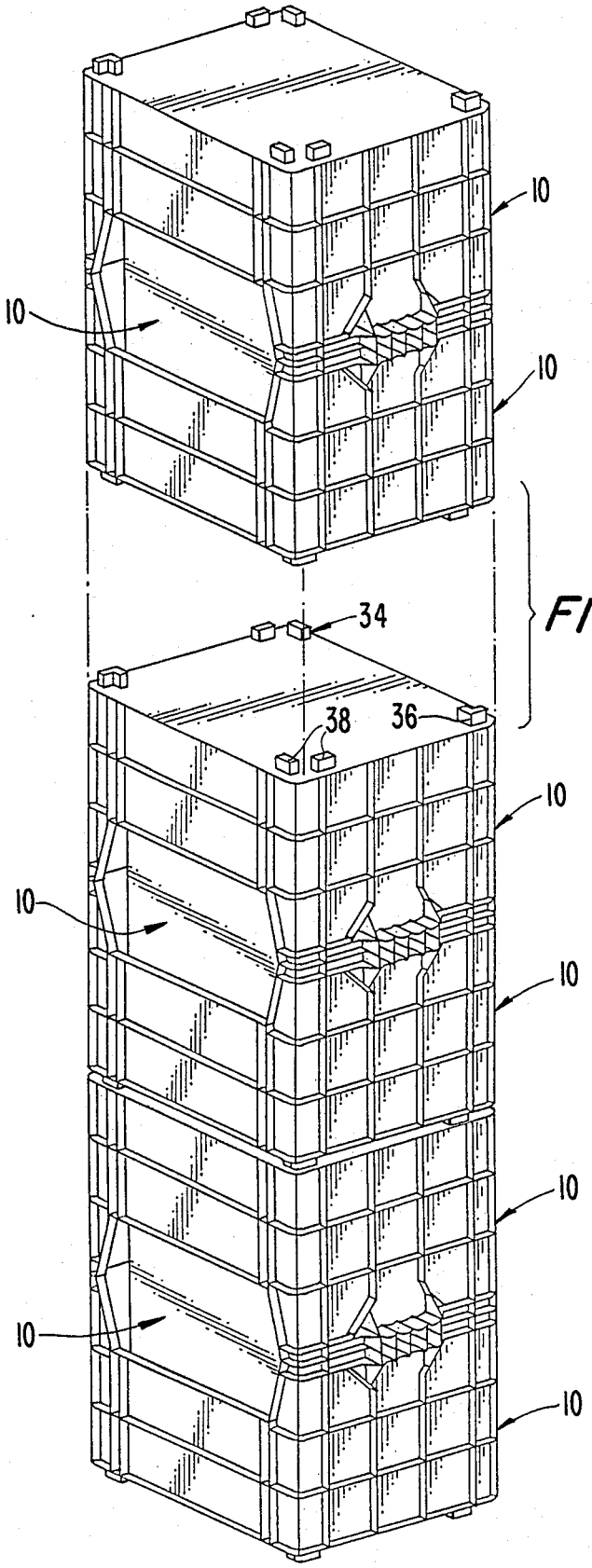
FIG. 6 is a perspective view of three sets of three nested storage containers being stacked bottom to bottom.

As shown in FIG. 6, sets of nest containers 10 may be stacked bottom to bottom. Feet 34 on one container 10 interfit with complementary feet 34 on an adjacent container 10. L-feet 36 on one container 10 interfit with spaced rectangular feet 38 on the adjacent container 10. As seen in FIG. 7, the L-shaped feet 36 engage one of the pair of spaced rectangular feet 38 by contacting fewer than three sides of each of the rectangular feet. Thus, no foot from one container is disposed within a foot from another container. Because of the asymmetrical relationship of feet 34 on each bottom surface 20, all bottom surfaces 20 may be stacked with any other bottom surface 20 of other containers. The interlocking complementary feet prevent relative lateral movement of the storage containers. This permits a set of three nested storage containers to be stacked with another set of three nested storage containers. Feet 34 prevent separation of the sets of storage containers within a 10 to 20° angle from the vertical. Storage containers 10 of the present invention are designed to be compatible with known containers having the same general dimensions so that they may stack top to bottom with known containers.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A nesting and stacking storage container comprising:

first and second spaced end walls having top edges and defining a rectangular opening therebetween;

a generally rectangular bottom joining said end walls;

handle means for gripping said storage container disposed on each of said end walls; and securing means integrally formed with said end walls and located on said handle means for releasably securing one of said storage containers to another of said storage containers when top edges of one container end walls are disposed on top edges of another container end walls.

2. A nesting and stacking storage container according to claim 1 having an integrally formed lattice construction.

3. A nesting and stacking storage container according to claim 1 wherein said handle means are located in the center adjacent the top edge of said end walls.

4. A nesting and stacking storage container according to claim 1 wherein said handle means comprises curved portions to accommodate grasping by the fingers of user.

5. A nesting and stacking storage container according to claim 1 wherein said handle means comprises vertical reinforcing ribs.

6. A nesting and stacking storage container according to claim 1 wherein said securing means on each said container comprises a male coupling element on one said end wall and a complementary female coupling element on the other said end wall, said male and female coupling elements being adapted to matingly engage the female and male coupling elements, respectively, on another said container to ensure the proper relative positioning of two mating containers, when two said storage containers are stacked top to top.

7. A nesting and stacking storage container according to claim 6, wherein said integral securing means comprises a tongue and groove connection, said tongue portion being disposed on one of said handle means and said groove portion being disposed on the opposite of said handle means.

8. A nesting and stacking storage container according to claim 1 further comprising feet located in each corner of the outer surface of said bottom, said feet being located inwardly from the edge of said bottom a distance sufficient to enable said feet of one said storage container to fit within the top opening of another said storage container when two said storage containers are stacked top to bottom.

9. A nesting and stacking storage container according to claim 8 wherein said feet permit two said storage containers to be stacked bottom to bottom while preventing relative lateral movement between the two said storage containers.

10. A nesting and stacking storage container according to claim 9 wherein said feet are asymmetrical with respect to both the central longitudinal and the central transverse axes of said bottom of said storage container.

11. A nesting and stacking storage container according to claim 10 wherein a single L-shaped foot is disposed at each of two diagonally opposed corners of said bottom and a pair of spaced rectangular feet are disposed at each of the other two diagonally opposed corners of said bottom.

12. A nesting and stacking storage container comprising:

first and second spaced end walls defining a rectangular opening therebetween;

a generally rectangular bottom joining said end walls;

handle means for gripping said storage container disposed on each of said end walls; and feet located in each corner of the outer surface of said bottom, said feet being located inwardly from the edge of said bottom a distance sufficient to enable said feet of one of said storage containers to fit within the top opening of another of said storage containers when two of said storage containers are stacked top to bottom, said feet permit two of said storage containers to be stacked bottom to bottom while preventing relative lateral movement between said storage containers, said feet are asymmetrical with respect to both central longitudinal and central transverse axes of said bottom of said storage container and a single L-shaped foot is disposed at each of two diagonally opposed corners of said bottom and a pair of spaced rectangular feet are disposed at each of the other two diagonally opposed corners of said bottom.

13. A nesting and stacking storage container according to claim 12 wherein said handle means are located in the center adjacent the top edge of said end walls.

14. A nesting and stacking storage container according to claim 13 wherein said handle means comprises curved portions to accommodate grasping by the fingers of a user.

15. A nesting and stacking storage container according to claim 13 wherein said handle means comprises vertical reinforcing ribs.

16. A nesting and stacking storage container according to claim 13 further comprising securing means integrally formed with said end walls for releasably securing the top edges of said end walls of one said storage container to the top edges of the end walls of another said storage container.

17. A nesting and stacking storage container according to claim 16 having an integrally formed lattice construction.

18. A nesting and stacking storage container according to claim 16 wherein said securing means on each said container comprises a male coupling element on one said end wall and a complementary female coupling element on the other said end wall, said male and female coupling elements being adapted to matingly engage the female and male coupling elements, respectively, on another said container to ensure the proper relative positioning of two mating containers, when two said storage containers are stacked top to top.

19. A nesting and stacking storage container according to claim 18 wherein said integral securing means comprises a tongue and groove connection, said tongue portion being disposed on one said wall and said groove portion being disposed on the opposite said end wall.

20. A nesting and stacking storage container according to claim 17 wherein said integral securing means are located on said handle means.

21. A nesting and stacking storage container according to claim 1, further comprising a pair of side walls joined to said end walls and said bottom.

22. A nesting and stacking storage container according to claim 2, wherein said end walls are equal in height to each other and at least one of said side walls is equal in height to both of said end walls.

23. A nesting and stacking storage container according to claim 12, further comprising a pair of side walls joined to said end walls and said bottom.

24. A nesting and stacking storage container according to claim 12, wherein when two of said storage containers are stacked bottom to bottom, each of said L-shaped feet engages one of said pair of spaced rectangular feet by contacting fewer than three sides of each of said rectangular feet without having any foot disposed within another foot.

* * * * *